US006392503B1

(12) United States Patent
Thornton

(10) Patent No.: US 6,392,503 B1
(45) Date of Patent: May 21, 2002

(54) HALF-SAWTOOTH MICROSTRIP DIRECTIONAL COUPLER

(75) Inventor: William Thornton, Dallas, TX (US)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/568,225

(22) Filed: May 9, 2000

(51) Int. Cl.[7] ..... H01P 5/18
(52) U.S. Cl. ..... 333/116; 333/238
(58) Field of Search ..... 333/116, 33, 238, 333/246

(56) References Cited

U.S. PATENT DOCUMENTS 3,629,733 A * 12/1971 Podell ..... 333/116
3,980,972 A * 9/1976 Podell et al. ..... 333/116

OTHER PUBLICATIONS

"*The Circuits and Filters Handbook*", Wai–Kai Chen, Editor, pp. 1188–1191 and 1239–1242, CRC Handbook Published in Cooperation with IEEE Press, 1995, Boca Raton, Florida.

* cited by examiner

*Primary Examiner*—Robert Pascal
*Assistant Examiner*—Kimberly E Glenn
(74) *Attorney, Agent, or Firm*—Banner & Witcoff, Ltd.

(57) ABSTRACT

A directional coupler includes a main arm and a branch arm. The main arm includes a first main sawtooth section, a second main sawtooth section and a main straight section coupled between the first and second main sawtooth sections. The branch arm includes a first branch sawtooth section and a second branch sawtooth section. The first branch sawtooth section includes a first side and a second side. The first side of the first branch sawtooth section is shaped to include a zig-zag edge and the second side of the first branch sawtooth section is shaped to include a non-straight edge. The second branch sawtooth section includes a first side and a second side, and the first side of the second branch sawtooth section is shaped to include a zig-zag edge. The zig-zag edge of the first side of the first branch sawtooth section is coupled to the first main sawtooth section, and the zig-zag edge of the first side of the second branch sawtooth section is coupled to the second main sawtooth section. In an alternative embodiment, a method to make a coupler includes steps of fabricating a coupler based on a first pattern, modifying the coupler, measuring a performance parameter of the coupler, and revising the first pattern to make a second pattern for use in making more couplers. The fabricated coupler includes a main arm and a branch arm. The main arm includes a first main sawtooth section, a second main sawtooth section and a main straight section coupled therebetween. The branch arm includes a first branch sawtooth section and a second branch sawtooth section. The first branch sawtooth section includes a first side and a second side wherein the first side of the first branch sawtooth section is shaped to include a zig-zag edge. The second branch sawtooth section includes a first side and a second side wherein the first side of the second branch sawtooth section is shaped to include a zig-zag edge. The zig-zag edge of the first side of the first branch sawtooth section is coupled to the first main sawtooth section, and the zig-zag edge of the first side of the second branch sawtooth section is coupled to the second main sawtooth section.

7 Claims, 5 Drawing Sheets

HALF-SAWTOOTH MICROSTRIP DIRECTIONAL COUPLER

BACKGROUND OF THE INVENTION

1. Field of the Invention

The present invention relates to strip line or microstrip directional couplers. In particular, the invention relates to sawtooth edge coupled directional couplers.

2. Description of Related Art

In FIG. 1, a conventional directional coupler 10 is depicted as a four port network having ports (1), (2), (3) and (4). Coupler 10 includes primary line 12 and secondary line 20. Primary line 12 includes coupled primary arm 14, first port feed 16 and second port feed 18. Secondary line 20 includes coupled secondary arm 22, third port bend 24, third port feed 28, fourth port bend 26 and fourth port feed 30. Power $P_1$ is provided to the coupler at first port (1), and powers $P_2$, $P_3$ and $P_4$ are measured as the output of ports (2), (3) and (4), respectively. The coupling factor CF of the coupler for coupling power that has been input in port (1) and output from port (3) is $P_3/P_1$, the directivity of the coupler is $P_4/P_3$, and the insertion loss of the coupler is $P_2/P_1$, although the coupling factor, the directivity and the insertion loss are usually expressed in decibels (dB). However, other definitions may be used. For example, the coupling factor CF may be defined to be $P_4/P_1$ (power coupled from port 1 to port 4) or $P_3/P_2$ (power coupled from port 2 to port 3) and the insertion loss of the coupler may be defined to be $P_1/P_2$.

FIG. 2 depicts a conventional microstrip transmission line, and FIG. 3 depicts a conventional strip line transmission line. Conventional coupler 10 is made from either conventional microstrip transmission lines or conventional strip line transmission lines. FIG. 4 depicts a conventional microstrip coupled transmission line pair, and FIG. 5 depicts a conventional strip line coupled transmission line pair as is formed between coupled primary arm 14 and coupled secondary aim 22 of FIG. 1.

In known couplers formed on a homogeneous medium, the solution to the well known Telegrapher's equations (of signal propagation) applied to the transmission line pair of either FIG. 4 or FIG. S reveals that signal transmission is possible only in one of two eigenmodes that each have electrical and magnetic field components only in a direction transverse to the propagation direction (i.e., TEM modes). These two TEM modes are conveniently labeled o for odd and e for even. For coupled strip lines (FIG. 5), the characteristic impedence of the two modes are different and are given by:

$$Z_{0e,o} = \frac{30\pi(b-t)}{\sqrt{\varepsilon_r}\left(W + \frac{bC_f}{2\pi}A_{e,o}\right)},$$

$$A_e = 1 + \frac{\ln(1+\tanh\theta)}{\ln 2},$$

$$A_o = 1 + \frac{\ln(1+\coth\theta)}{\ln 2},$$

$$\theta = \frac{\pi S}{2b}, \text{ and}$$

$$C_f(t/b) = 2\ln\left(\frac{2b-t}{b-t}\right) - \frac{t}{b}\ln\left[\frac{t(2b-t)}{(b-t)^2}\right].$$

If the power coupling factor per meter k(x) is known or calculated from first principals, the coupling factor of the coupler can be computed by integrating along the length from x=0 to x=l of the coupled transmission lines (14 and 22 in FIG. 1) as follows:

$$CF = \left|\int k(x)\exp(-j\beta x)dx\right|,$$

where β is the propagation factor for the particular mode (odd or even) which may be different for the two modes. Similarly, directivity can be computed to be:

$$dir = \frac{1}{CF}\left|\int k(x)\exp(-j2\beta x)dx\right|,$$

and insertion loss IL=1−CF(1-dir). Typically, the directivity of the conventional coupler of FIG. 1 is about 14 dB, worst case.

FIG. 6 depicts a known sawtooth coupler. The zig-zag edge increases the power coupling factor per meter k(x) in both the primary line and the secondary line, slows the wave propagation velocity, and the directivity remains dependent on the wave propagation velocity, as well as other factors, along the primary and secondary lines.

SUMMARY OF THE INVENTION

It is an object to the present invention to provide a directional coupler that has improved directivity. It is a further object of the present invention to provide a directional coupler whose directivity is less sensitive to manufacturing process variations.

These and other objects are achieved in a directional coupler that includes a main arm and a branch arm. The main arm includes a first main sawtooth section, a second main sawtooth section and a main straight section coupled between the first and second main sawtooth sections. The branch arm includes a first branch sawtooth section and a second branch sawtooth section. The first branch sawtooth section includes a first side and a second side. The first side of the first branch sawtooth section is shaped to include a zig-zag edge and the second side of the first branch sawtooth section is shaped to include a non-straight edge. The second branch sawtooth section includes a first side and a second side, and the first side of the second branch sawtooth section is shaped to include a zig-zag edge. The zig-zag edge of the first side of the first branch sawtooth section is coupled to the first main sawtooth section, and the zig-zag edge of the first side of the second branch sawtooth section is coupled to the second main sawtooth section.

These and other objects are achieved with a method to make a coupler that includes steps of fabricating a coupler based on a first pattern, modifying the coupler, measuring a performance parameter of the coupler, and revising the first pattern to make a second pattern for use in making more couplers. The fabricated coupler includes a main arm and a branch arm. The main arm includes a first main sawtooth section, a second main sawtooth section and a main straight section coupled therebetween. The branch arm includes a first branch sawtooth section and a second branch sawtooth section. The first branch sawtooth section includes a first side and a second side wherein the first side of the first branch sawtooth section is shaped to include a zig-zag edge. The second branch sawtooth section includes a first side and a second side wherein the first side of the second branch sawtooth section is shaped to include a zig-zag edge. The zig-zag edge of the first side of the first branch sawtooth section is coupled to the first main sawtooth section, and the zig-zag edge of the first side of the second branch sawtooth section is coupled to the second main sawtooth section.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

Figure 7:
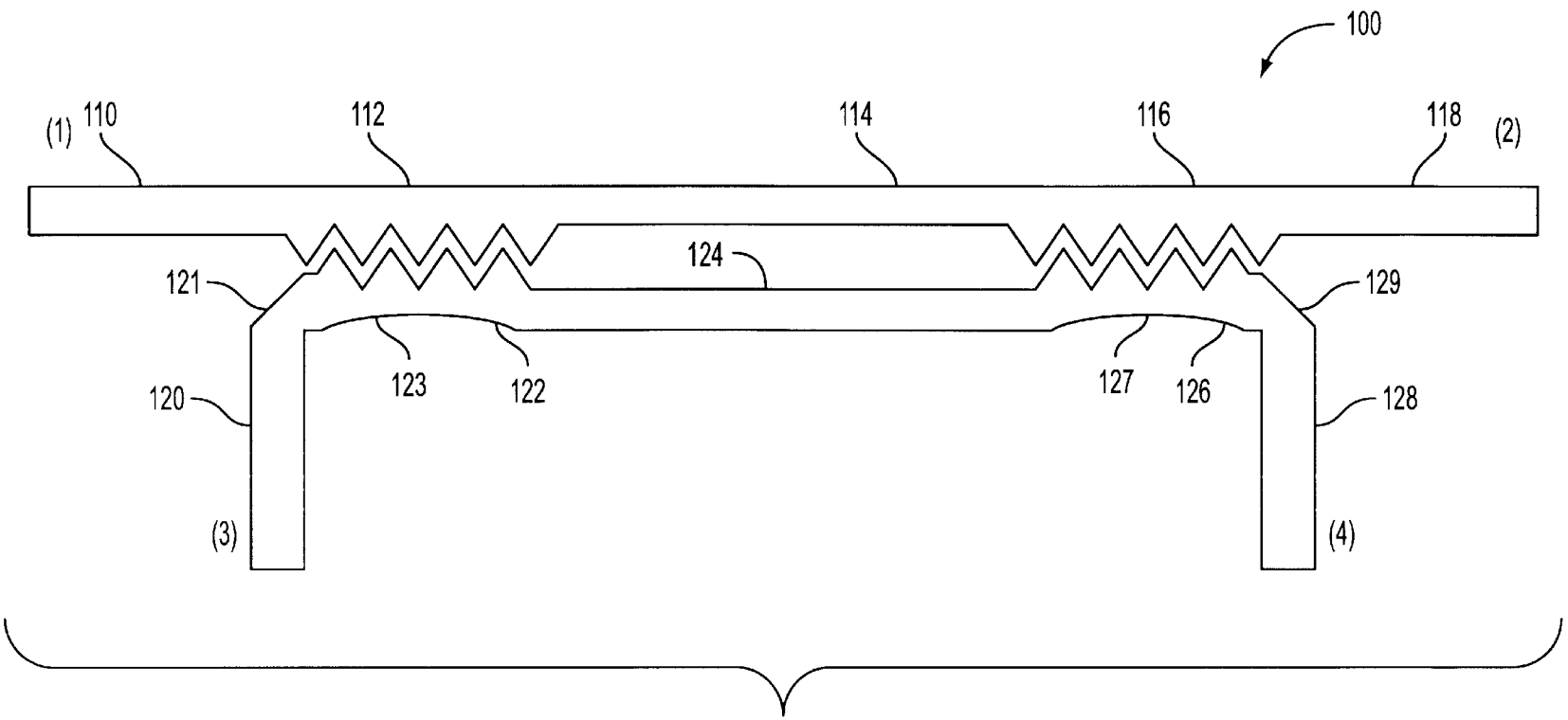
FIG. 7 is a plan view of a split sawtooth directional coupler according to the present invention.

In FIG. 7, split sawtooth directional coupler 100 is depicted as a four port network having ports (1), (2), (3) and (4). Coupler 100 includes a primary line (or main arm) that includes coupled primary arm 114, first port feed 110 first port sawtooth section 112, second port feed 118 and second port sawtooth section 116. Coupler 100 also includes a secondary line (or coupled arm) that includes coupled secondary arm 124, third port feed 120 with bend 121, third port sawtooth section 122 with arching notch 123, fourth port feed 128 with bend 129 and fourth port sawtooth section 126 with arching notch 127. Power $P_1$ is provided to the coupler at first port (1), and powers $P_2$, $P_3$ and $P_4$ are measured as the output of ports (2), (3) and (4), respectively. The coupling factor CF for the coupler is $P_3/P_1$, the directivity dir of the coupler is $P_4/P_3$, and the insertion loss of the coupler is $P_2/P_1$, although the coupling factor, the directivity and the insertion loss are usually expressed in decibels (dB).

Figure 1:
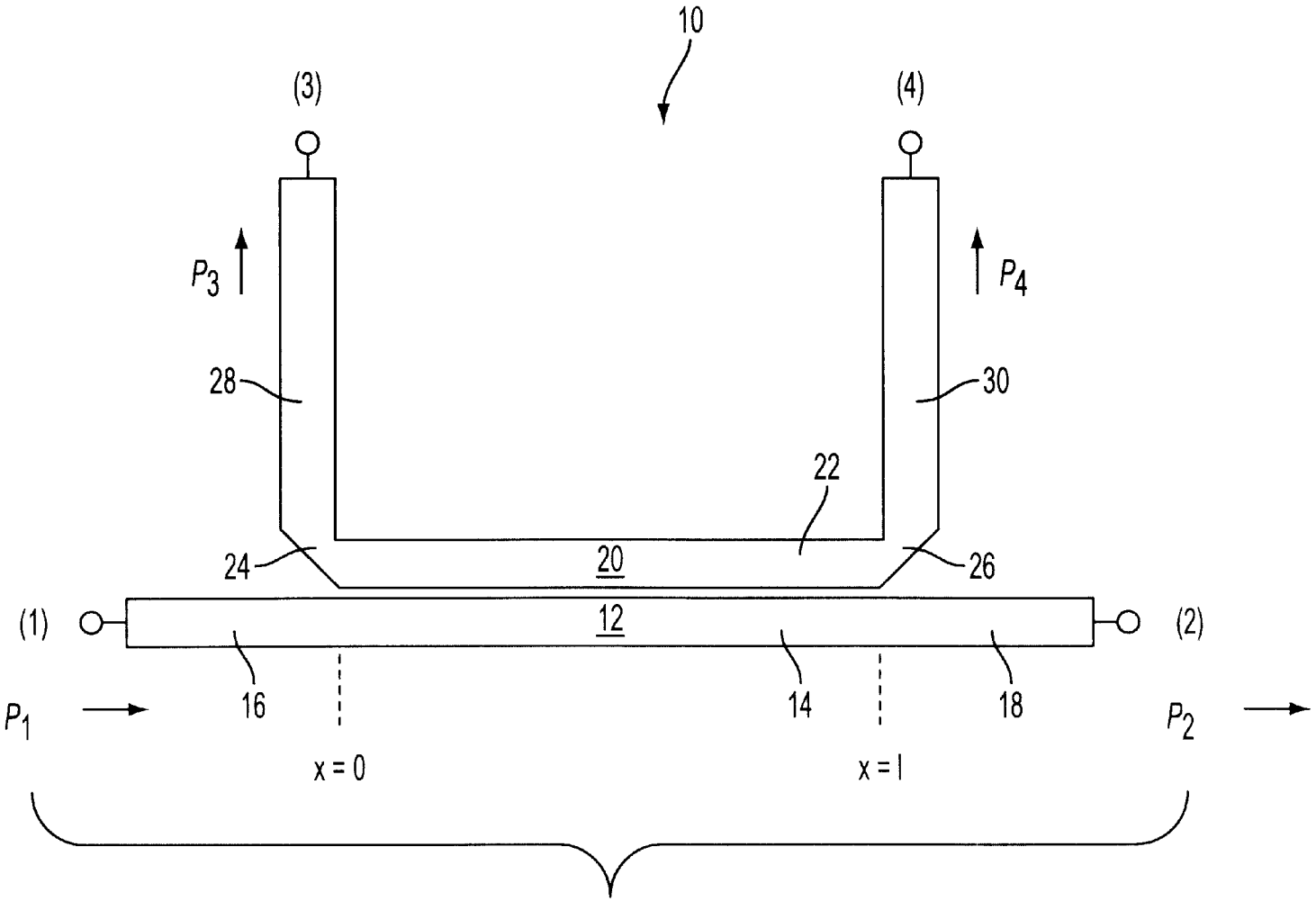
FIG. 1 (PRIOR ART)
FIG. 1 is a plan view of a known directional coupler.
Figure 2:
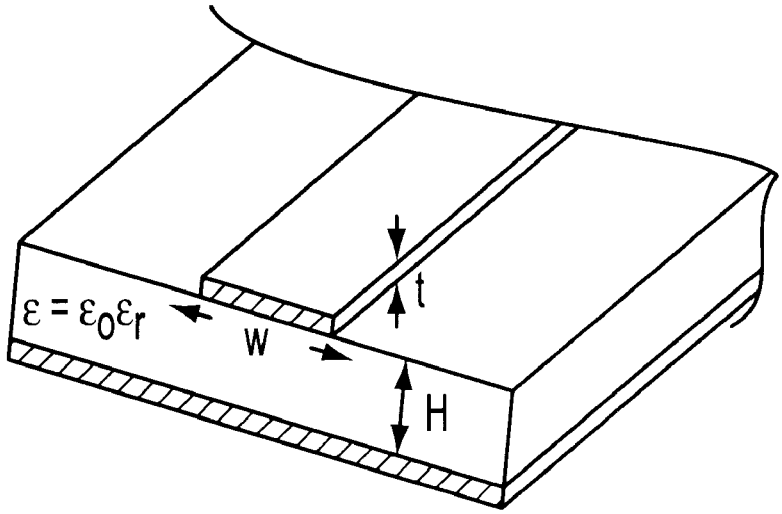
FIG. 2 (PRIOR ART)
FIG. 2 is a perspective view of a known microstrip transmission line.
Figure 3:
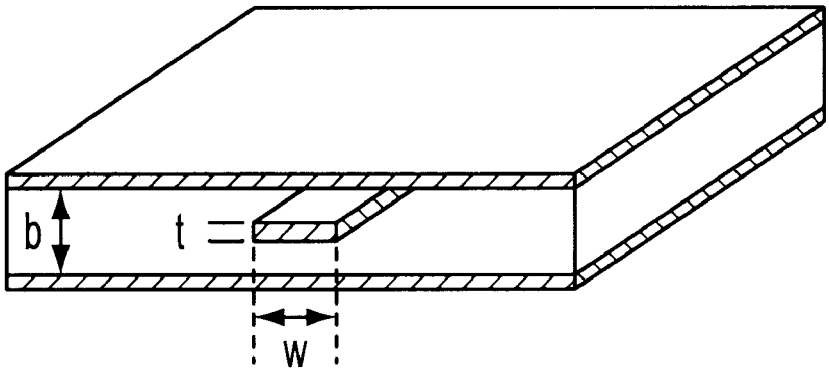
FIG. 3 (PRIOR ART)
FIG. 3 is a perspective view of a known strip line transmission line.
Figure 4:
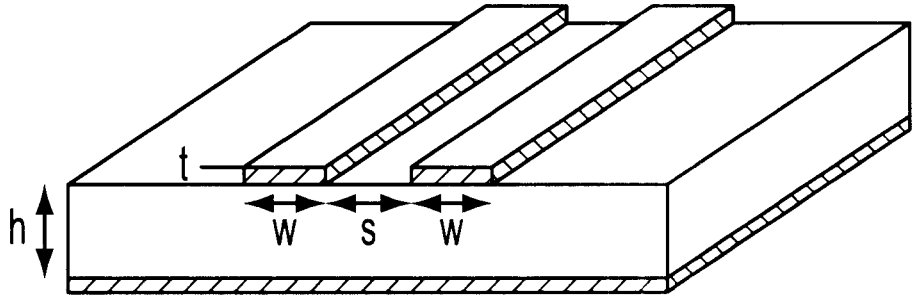
FIG. 4 (PRIOR ART)
FIG. 4 is a perspective view of a known microstrip transmission line coupled pair.

This directional coupler is preferrably implemented with microstrip transmission lines or strip line transmission lines. Sawtooth sections 112, 116, 122 and 126 serve to increase the capacitance coupling between the primary and secondary lines as spaced apart points. This helps equalize the coupling between the primary and secondary lines for both even and odd propagation modes. Since the separation of the sawtooth regions (i.e., regions of high coupling) defines a baseline length for both even and odd propagation modes, the coupling between the primary and secondary lines is equalized as between the even and odd propagation modes, and the fabrication of such couplers is less sensitive to manufacturing variations. Since the coupling is equalized between the even and odd modes, the coupler has greater directivity than conventional directional couplers. The present design has been demonstrated by simulation to achieve a directivity of 27.3 dB, worst case, with a standard deviation of 1.26 dB. This compares favorably to the 14 dB directivity achievable by conventional directional couplers (FIG. 1).

In FIG. 7, arched notches 123 and 127 help tune the coupler's center frequency, coupling factor and directivity by changing the wave propagation velocity and coupling coefficent through sawtooth sections 122 and 126. The arch serves as a vernier control on the coupling in the sawtooth regions.

In an alternative embodiment of the present invention, a method to make a coupler includes steps of fabricating a coupler based on a first pattern, modifying the coupler to adjust a performance parameter of the coupler (e.g., the directivity), measuring the performance parameter of the coupler, and revising the first pattern to make a second pattern for use in making more couplers.

The step of fabricating the coupler makes the coupler by known processes such as by etching of a metal (e.g., copper) clad or plated insulation board (e.g., epoxy-fiberglass, alumna, etc). The coupler includes a main arm and a branch arm. The main arm includes a first main sawtooth section, a second main sawtooth section and a main straight section coupled therebetween. The branch arm includes a first branch sawtooth section and a second branch sawtooth section. The first branch sawtooth section includes a first side and a second side wherein the first side of the first branch sawtooth section is shaped to include a zig-zag edge. The second branch sawtooth section includes a first side and a second side wherein the first side of the second branch sawtooth section is shaped to include a zig-zag edge. The zig-zag edge of the first side of the first branch sawtooth section is coupled to the first main sawtooth section, and the zig-zag edge of the first side of the second branch sawtooth section is coupled to the second main sawtooth section.

The step of modifying modifies the second side of the first branch sawtooth section or modifies the second side of the second branch sawtooth section, or both, to adjust the performance parameter (e.g., directivity) of the coupler. This modification may take the form of cutting the second side of the first or second branch sawtooth sections with a sharp knife to remove an arch of conductive material or to cut small notches in the second side. Then, the performance parameter of the coupler is measured.

If the measured performance parameter is not the desired parameter value, the steps of modifying and measuring are repeated until the performance parameter, as measured, is substantially equal to a desired parameter value. When the desired parameter value is achieved, the first pattern is revised based on the modified coupler to make a second pattern for use in making more couplers.

This method has distinct advantages over known methods of making couplers. In known methods, a designer would calculate the dimensions of the coupler, make a pattern, make a test coupler and then measure a performance parameter such as directivity. If the measured performance parameter was not a desired parameter value, the designer would then re-calculate the dimensions of the coupler, make another pattern, make another test coupler and then re-measure the performance parameter. Successive repeats of the entire design cycle is necessary to achieve the desired parameter value.

With the present invention, the designer need not successively iterate the design to determine the optimal sawtooth spacing, number of teeth, length and height of the teeth, etc. Instead, the designer chooses teeth parameters that are close and finds the optimal point by cutting notches with a knife in the second side of the first or second branch sawtooth sections until the desired parameter value is achieved. Then, the dimensions of the notch is measured and this measurement is used to modify the pattern to be used to make other couplers.

Having described preferred embodiments of a novel split sawtooth directional coupler (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as defined by the appended claims. Having thus described the invention with the details and particularity required by the patent laws, what is claimed and desired protected by letters patent is set forth in the appended claims:

What is claimed is:

1. A coupler comprising:

a main arm that includes a first main sawtooth section, a second main sawtooth section and a main straight section coupled between the first and second main sawtooth sections; and a branch arm that includes a first branch sawtooth section and a second branch sawtooth section, the first branch sawtooth section including a first side and a second side, the first side of the first branch sawtooth section being shaped to include a zig-zag edge, the second side of the first branch sawtooth section being shaped to include a non-straight edge, the second branch sawtooth section including a first side and a second side, the first side of the second branch sawtooth section being shaped to include a zig-zag edge, the zig-zag edge of the first side of the first branch sawtooth section being coupled to the first main sawtooth section, the zig-zag edge of the first side of the second branch sawtooth section being coupled to the second main sawtooth section.

2. The coupler of claim 1, wherein the second side of the second branch sawtooth section is shaped to include a notched edge.

3. The coupler of claim 1, wherein the notched edge that is the second side of the first branch sawtooth section is a concave arch.

4. The coupler of claim 1, wherein a width of said first branch sawtooth section at a center of the non-straight edge is less than a width of said first branch sawtooth section at an end of said non-straight edge.

5. A method to make a coupler comprising steps of:

fabricating a coupler based on a first pattern, the coupler having a main arm and a branch arm, the main arm including a first main sawtooth section, a second main sawtooth section and a main straight section coupled therebetween, the branch arm including a first branch sawtooth section and a second branch sawtooth section, the first branch sawtooth section including a first side and a second side wherein the first side of the first branch sawtooth section is shaped to include a zig-zag edge, the second branch sawtooth section including a first side and a second side wherein the first side of the second branch sawtooth section is shaped to include a zig-zag edge, the zig-zag edge of the first side of the first branch sawtooth section being coupled to the first main sawtooth section, the zig-zag edge of the first side of the second branch sawtooth section being coupled to the second main sawtooth section;

modifying the second side of the first branch sawtooth section to adjust a performance parameter of the coupler;

measuring the performance parameter of the coupler; and revising the first pattern to make a second pattern for use in making more couplers.

6. The method of claim 5, further including a step of repeating the steps of modifying and measuring until the performance parameter is measured to be substantially equal to a desired parameter value.

7. The method of claim 5, wherein the performance parameter is directivity.

* * * * *

UNITED STATES PATENT AND TRADEMARK OFFICE

CERTIFICATE OF CORRECTION

PATENT NO. : 6,392,503 B1
DATED : May 21, 2002
INVENTOR(S) : William Thornton

Figure 5:
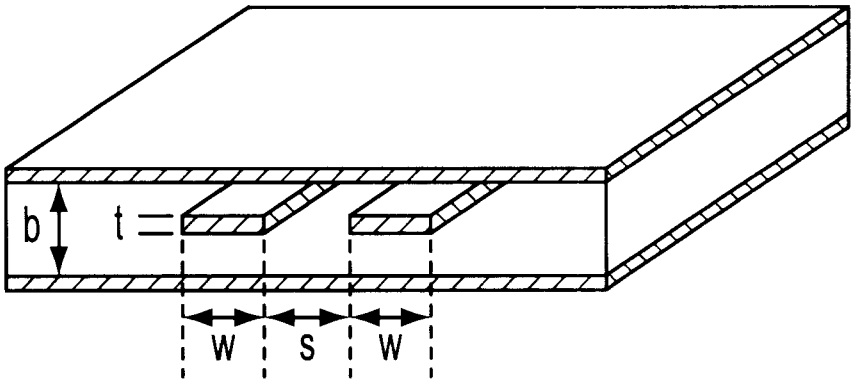
FIG. 5 (PRIOR ART)
FIG. 5 is a perspective view of a known strip line transmission line coupled pair.
Figure 6:
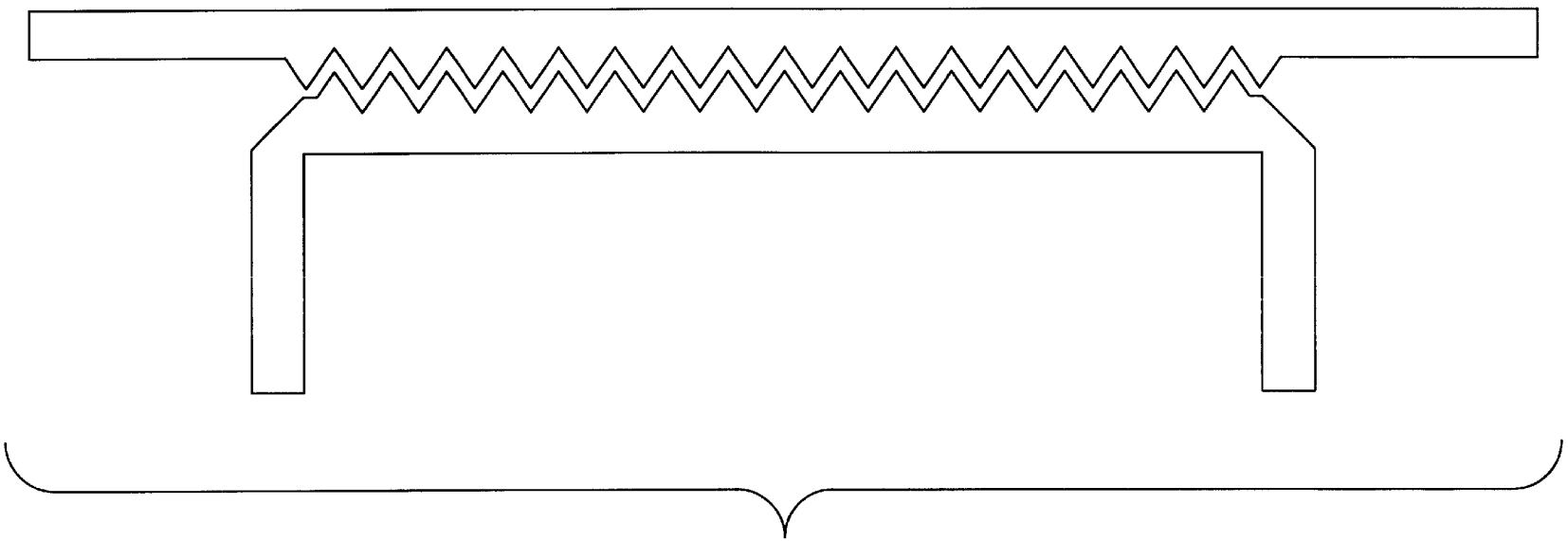
FIG. 6 (PRIOR ART)
FIG. 6 is a plan view of a known sawtooth directional coupler.

It is certified that error appears in the above-identified patent and that said Letters Patent is hereby corrected as shown below:

Column 1,
Line 39, "aim" has been replaced with -- arm --,
Line 43, "FIG. S" has been replaced with -- FIG. 5 --.

Column 3,
Line 12, "pair," has been replaced with -- pair; --.

Signed and Sealed this

Seventeenth Day of September, 2002

*Attest:*

*Attesting Officer*

JAMES E. ROGAN
*Director of the United States Patent and Trademark Office*